US009814335B2

(12) United States Patent
Beck, Jr.

(10) Patent No.: US 9,814,335 B2
(45) Date of Patent: Nov. 14, 2017

(54) DISPOSABLE LID FOR DRINK CONTAINERS

(71) Applicant: Gary E. Beck, Jr., Poughkeepsie, NY (US)

(72) Inventor: Gary E. Beck, Jr., Poughkeepsie, NY (US)

( * ) Notice: Subject to any disclaimer, the term of this patent is extended or adjusted under 35 U.S.C. 154(b) by 0 days.

(21) Appl. No.: 15/049,285

(22) Filed: Feb. 22, 2016

(65) Prior Publication Data

US 2016/0262558 A1 Sep. 15, 2016

Related U.S. Application Data

(60) Provisional application No. 62/133,400, filed on Mar. 15, 2015.

(51) Int. Cl.

| | |
|---|---|
| ***A47G 19/22*** | (2006.01) |
| ***B65D 1/02*** | (2006.01) |
| ***B65D 1/12*** | (2006.01) |
| ***B65D 51/18*** | (2006.01) |
| ***B65D 51/20*** | (2006.01) |

(52) U.S. Cl.

CPC ..... *A47G 19/2272* (2013.01); *A47G 19/2266* (2013.01); *B65D 1/023* (2013.01); *B65D 1/12* (2013.01); *B65D 51/185* (2013.01); *B65D 51/20* (2013.01); *B65D 2231/022* (2013.01); *B65D 2251/0015* (2013.01); *B65D 2251/0031* (2013.01); *B65D 2251/0071* (2013.01); *B65D 2251/0093* (2013.01); *B65D 2517/0049* (2013.01)

(58) Field of Classification Search

CPC ..... A47G 19/2272; A47G 19/2266; A47G 19/2222; B65D 1/023; B65D 1/12; B65D 51/185; B65D 51/18; B65D 51/20; B65D 45/32; B65D 39/04; B65D 41/0485; B65D 41/0407; B65D 41/0435; B65D 17/163; B65D 17/168

USPC ..... 215/229, 228, 45, 44, 43, 275, 274, 273, 215/279, 305, 295, 388, 387; 220/320, 220/319, 315, 287, 709, 705, 304, 270, 220/266, 265; 277/630, 652, 650, 644; D7/300.2; D9/436, 435

See application file for complete search history.

(56) References Cited

U.S. PATENT DOCUMENTS 1,471,140 A * 10/1923 Brown ..... B65D 43/0212 215/295
2,948,453 A * 8/1960 Drown ..... B65D 47/283 215/388
3,244,308 A * 4/1966 Esposito, Jr. ..... B65D 39/04 215/270

(Continued)

FOREIGN PATENT DOCUMENTS

GB 2238303 A 5/1991

*Primary Examiner* — Robert J Hicks

(74) *Attorney, Agent, or Firm* — Law Offices of Michael L. Wise, LLC

(57) ABSTRACT

An apparatus includes a drinking container and a lid. The lid encircles a portion of the drinking container, and includes a body and a rim. The body is formed of an elastomeric material and defines a hollow pocket with an open end and an aperture or scored region. The rim is formed of the elastomeric material and defines a ring running about the open end. Lids in accordance with aspects of the invention are capable of capturing and suspending straws, and preventing spills.

15 Claims, 4 Drawing Sheets

(56) References Cited

U.S. PATENT DOCUMENTS

| | | | | | |
|---|---|---|---|---|---|
| 3,371,847 | A * | 3/1968 | Stengle, Jr. | B65D 43/0218 | 215/292 |
| 3,378,163 | A * | 4/1968 | Griffith | B65D 15/06 | 220/260 |
| 3,779,416 | A * | 12/1973 | Wilcox | B65D 39/04 | 215/254 |
| 4,901,881 | A * | 2/1990 | McElroy | B65D 41/22 | 215/229 |
| 4,948,009 | A * | 8/1990 | Sawatani | A23F 5/243 | 215/388 |
| 4,992,037 | A * | 2/1991 | Hwang | B29C 41/14 | 264/303 |
| 5,664,694 | A * | 9/1997 | Bietzer | B29C 65/368 | 215/232 |
| 6,196,408 | B1 * | 3/2001 | Setty | B65D 3/261 | 220/270 |
| 2015/0076104 | A1 * | 3/2015 | Sleebos | A47G 19/2266 | 215/316 |

* cited by examiner

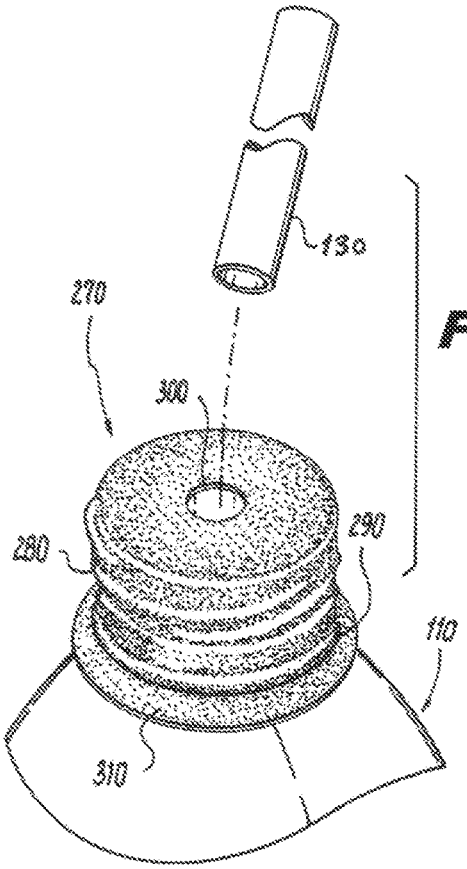
Fig. 6
Fig. 7
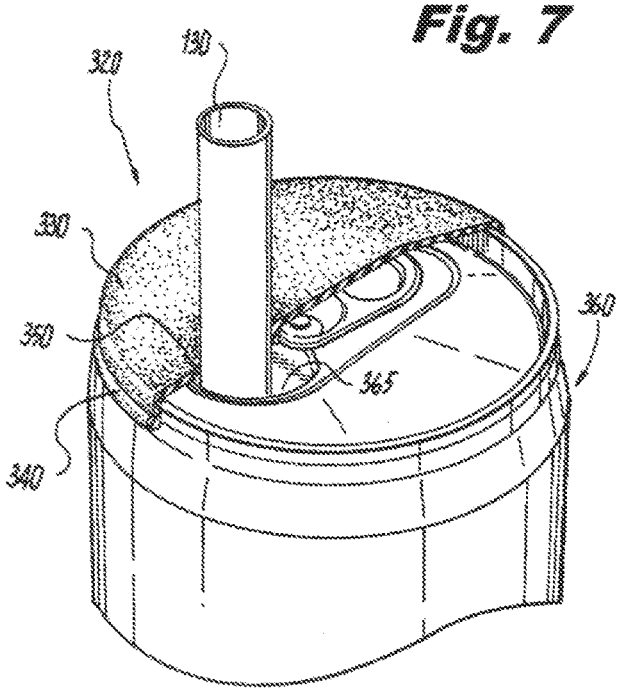

DISPOSABLE LID FOR DRINK CONTAINERS

FIELD OF THE INVENTION

The present invention relates to containers for storage or transport, and, more particularly to, lids or caps for drinking containers.

BACKGROUND OF THE INVENTION

Using a straw to drink from a water bottle or other such drinking container is frequently difficult and frustrating. If the straw is too short in relation to the container, the straw has a tendency to drop into the container, where it becomes lost and unusable. At the same time, the contents of the same container may be easily spilled if the container is inadvertently tilted or dropped. Such problems are particularly acute when the person doing the drinking is a child.

There is, as a result, the need for a technology that may help alleviate these issues.

SUMMARY OF THE INVENTION

Embodiments of the present invention address the above-identified needs by providing designs for elastomeric lids for use with drinking containers. These lids are capable of capturing and suspending straws, and preventing spills.

Aspects of the invention are directed to an apparatus comprising a body and a rim. The body is formed of an elastomeric material and defines a hollow pocket with an open end and an aperture or scored region. The rim is formed of the elastomeric material and defines a ring running about the open end.

Additional aspects of the invention are directed to an apparatus comprising a drinking container and a lid. The lid encircles a portion of the drinking container, and comprises a body and a rim. The body is formed of an elastomeric material and defines a hollow pocket with an open end and an aperture or scored region. The rim is formed of the elastomeric material and defines a ring running about the open end.

BRIEF DESCRIPTION OF THE DRAWINGS

Features, aspects, and advantages of the present invention will become better understood with regard to the following description, appended claims, and accompanying drawings where:

FIG. 6 shows a perspective view of a fourth lid applied to a bottle, in accordance with an illustrative embodiment of the invention; and FIG. 7 shows a perspective view of a fifth lid applied to a can, in accordance with an illustrative embodiment of the invention.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
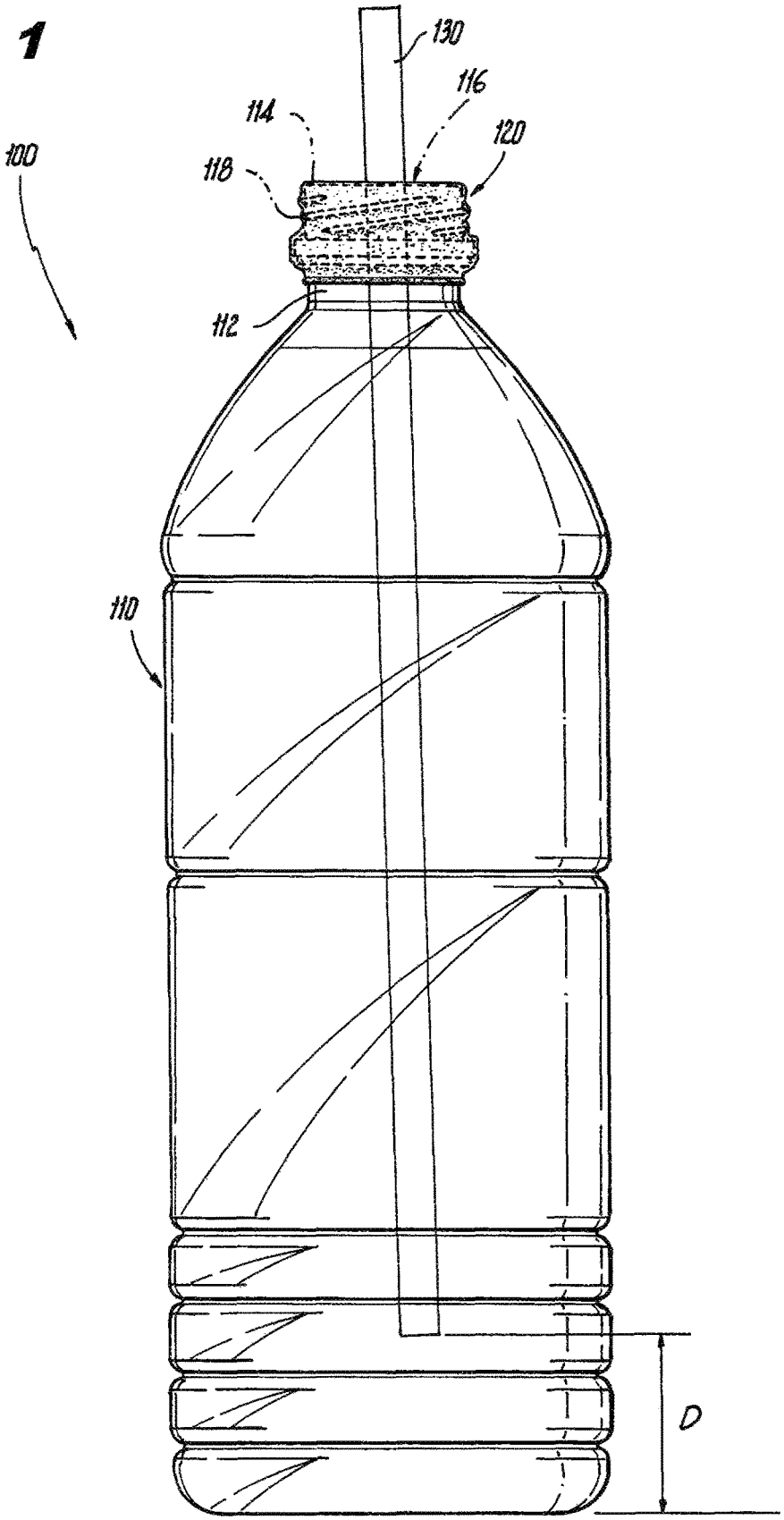
FIG. 1 shows an elevational view of an apparatus in accordance with an illustrative embodiment of the invention.

FIG. 1 shows an apparatus 100 in accordance with an illustrative embodiment of the invention. The apparatus 100 comprises: a bottle 110, a lid 120, and a straw 130. In the present embodiment, the bottle 110 is of the type that might be obtained when buying a soft drink or bottled water. The bottle 110 defines a bottle neck 112 with a bottle rim 114 that surrounds a bottle opening 116. Threads 118 allow a cap (not shown) to be removably attached to the bottle 110.

Figure 2:
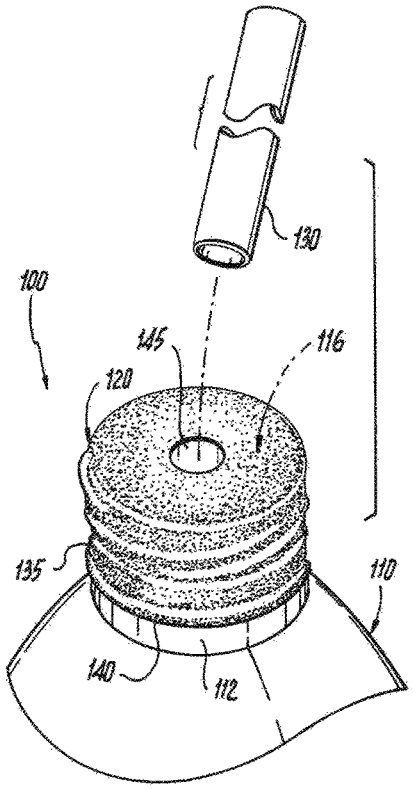
FIG. 2 shows an exploded perspective view of elements of the FIG. 1 apparatus.

FIG. 2 shows an exploded perspective view of elements of the apparatus 100, namely, the bottle 110, the lid 120, and the straw 130. The lid 120 comprises a lid body 135, a lid rim 140, and a lid aperture 145. As will be detailed below, the lid 120 comprises an elastomeric material with a high stretch ratio and high resilience. The lid 120 envelopes a top region of the bottle neck 112 and spans across the bottle opening 116 of the bottle 110. So positioned, the lid aperture 145 is disposed near the center of the bottle opening 116. The straw 130 may be inserted through the lid aperture 145 to obtain the apparatus 100 shown in FIG. 1. The lid aperture 145 preferably has a diameter somewhat smaller than that of the straw 130 so that the lid aperture 145 imposes a compressive force on the straw 130, thereby inhibiting the straw 130 from moving up and down in the lid aperture 145. A straw 130 that is too short to reach the bottom of the bottle 110 may thereby be suspended in the bottle 110, as is shown in FIG. 1 (the bottom of the straw 130 is suspended above the bottom of the bottle 110 by distance D).

Figure 3:
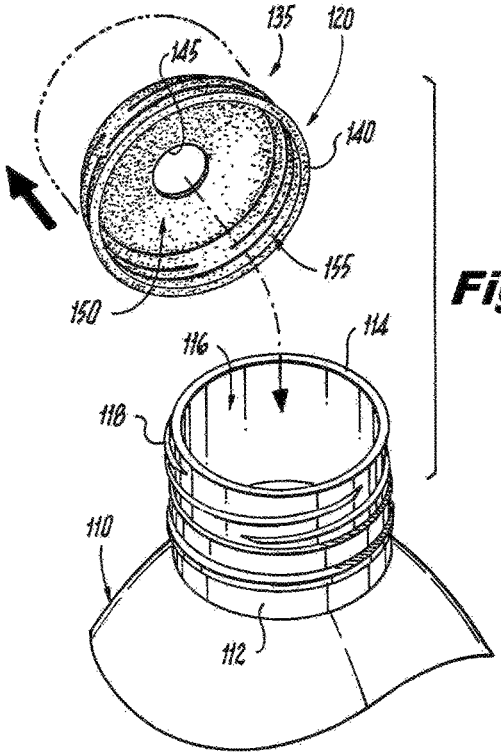
FIG. 3 shows a perspective view of elements of the FIG. 1 apparatus just before the lid is applied to the bottle.

FIG. 3 shows a perspective view of the lid 120 and the bottle 110 as they might appear just before the lid 120 is placed on the bottle 110. The lid body 135 defines a hollow pocket 150 with an open end 155. The lid rim 140 is a ring that is distinct from the lid body 135 and runs about the open end 155. The lid aperture 145 sits at the top of the hollow pocket 150 opposite the open end 155. The lid 130 elastically expands as it is placed on the neck 112 of the bottle 110 (broken lines and arrow in FIG. 3).

Figure 4:
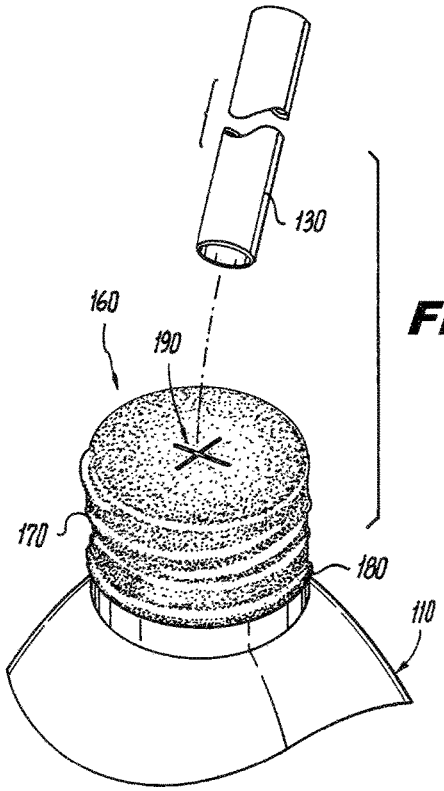
FIG. 4 shows a perspective view of a second lid applied to a bottle, in accordance with an illustrative embodiment of the invention.

While the lid 120 in FIGS. 2 and 3 include the lid aperture 145 to accommodate the straw 130, alternative designs may be utilized. FIG. 4 shows a perspective view of a second lid 160 applied to the bottle 110, in accordance with an illustrative embodiment of the invention. The second lid 160 includes a second lid body 170 and a second lid rim 180 similar to those of the lid 120. However, rather than having the lid aperture 145, the second lid 160 includes a scored region 190 (i.e., lines of weakness) that may be broken open to accommodate the straw 130. In the present embodiment, the scored region 190 describes a cross or x-shape.

Figure 5:
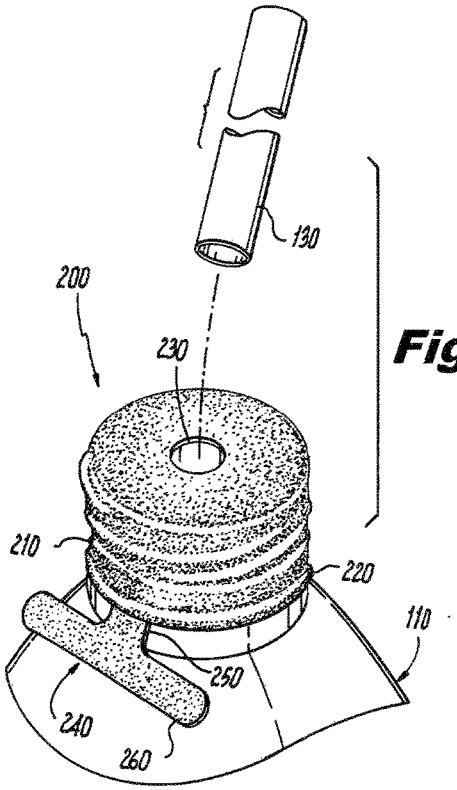
FIG. 5 shows a perspective view of a third lid applied to a bottle, in accordance with an illustrative embodiment of the invention.

Alternative lids may also include additional features such as tabs and flaps. FIG. 5 shows a perspective view of a third lid 200 applied to the bottle 110, in accordance with an illustrative embodiment of the invention. In addition to a third lid body 210, a third lid rim 220, and a third lid aperture 230, the third lid 200 includes a t-shaped tab 240 that extends from the third lid rim 220. The t-shaped tab 240 includes a narrow connector portion 250 and a larger elongate flap portion 260. The flap portion 260 facilitates a user in applying and removing the third lid 200 to and from the bottle 110. The flap portion 260 is also an ideal place to add branding to the third lid 200. This branding may, for example, comprise text and/or logos associated with sports teams and the like.

FIG. 6 shows a perspective view of a fourth lid 270 applied to the bottle 110, in accordance with an illustrative embodiment of the invention. In addition to a fourth lid body 280, a fourth lid rim 290, and a fourth lid aperture 300, the fourth lid further comprises an annular fourth lid flap 310 that projects outward from an entirety of the fourth lid rim 290. Here again, the fourth lid flap 310 eases installation and removal of the fourth lid 270 to and from the bottle 110, while also creating surface space for branding. While the fourth lid flap 310 extends all the way around the fourth lid rim 290, in alternative embodiments, it may extend only part way around.

Lastly, FIG. 7 shows a fifth lid 320 with a lid body 330, a lid rim 340, and a lid aperture 350 applied to a can 360, in accordance with an illustrative embodiment of the invention. In the present embodiment, the can 360 has a tab-actuated opening 365, and may be of the type received when purchasing a soft drink. The fifth lid 320 works in much the same way of the previously described lids 120, 160, 200, 270, but is applied to the upper portion of the can 360 such that the lid aperture 350 overlies the opening 365 in the can 360.

The lids 120, 160, 200, 270, 320 will preferably exhibit a large stretch ratio, high resilience, and be extremely waterproof. By large stretch ratio, a ratio of three or more is contemplated to allow the lids 120, 160, 200, 270, 320 to deform sufficiently to differently sized containers. At the same time, the lids 120, 160, 200, 270, 320 will preferably be formed of a material that is safe for contact with food. There are many elastomeric materials that fit these requirements. These include natural and synthetic rubbers such as, as just one example, natural latex rubber. Natural latex rubber is presently used in the manufacture of a number of commercial products such as surgeons' gloves, condoms, and balloons. If allergic reactions are of concern, latex from non-Hevea sources, such as Guayule, can be used without allergic reaction by person with allergy to Hevea latex. These and other suitable materials, as well as techniques for manufacturing products therefrom, are set forth in, for example, NIR Board of Consultants and Engineers, *The Complete Book on Rubber Processing and Compounding Technology*, Asia Pacific Business Press Inc., 2010, which is hereby incorporated by reference herein.

The above-described lids 120, 160, 200, 270, 320 and, more generally, lids in accordance with aspects of the invention provide several advantages. The lids 120, 160, 200, 270, 320, for example, are highly deformable and are thereby able to adapt to bottles of differing sizes and shapes, making the lids 120, 160, 200, 270, 320 universal to many drinking containers, where the term "drinking container" is used herein to mean a cup, glass, bottle, can, flask, canteen, and the like. As a result, a user need not obtain, store, and transport multiple lid sizes to accommodate different containers, but may instead just utilize a single size of lid. The lids 120, 160, 200, 270, 320 are also able to stop spills and to "suspend" a straw, as indicated above. Finally, the lids 120, 160, 200, 270, 320 are easy and inexpensive to manufacture, are small and light, disposable, and provide branding opportunities. When densely packaged in a bag or box, the lids will occupy a small volume. One hundred fifty lids may, for example, occupy only about 320 cubic centimeters.

It should again be emphasized that the above-described embodiments of the invention are intended to be illustrative only. Other embodiments can use different types and arrangements of elements for implementing the described functionality. These numerous alternative embodiments within the scope of the invention will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in AIA 35 U.S.C. §112(f). In particular, the use of "step of" in the claims herein is not intended to invoke the provisions of AIA 35 U.S.C. §112(f).

What is claimed is:

1. An apparatus comprising:
- a body formed of an elastomeric material and defining a hollow pocket with an open end and an aperture or scored region;
- a rim formed of the elastomeric material and defining a ring running about the open end; and
- a t-shaped tab extending from the rim;
- wherein the aperture or scored region is positioned opposite the open end, and the aperture, when present, has a smaller diameter than the open end.

2. The apparatus of claim 1, wherein the scored region describes a cross.

3. The apparatus of claim 1, wherein the aperture or the scored region, when opened, is sized to accommodate a straw while placing a compressive force on the straw.

4. The apparatus of claim 1, wherein the apparatus comprises a rubber.

5. The apparatus of claim 1, wherein the apparatus comprises natural latex rubber.

6. The apparatus of claim 1, wherein the apparatus comprises a non-Hevea latex rubber.

7. The apparatus of claim 1, further comprising a flap projecting outward from an entirety of the rim.

8. An apparatus comprising:
- a drinking container that narrows down to a neck with an opening; and
- a lid encircling a portion of the neck, and comprising:
  - a body formed of an elastomeric material and defining a hollow pocket with an open end and an aperture or scored region; and
  - a rim formed of the elastomeric material and defining a ring running about the open end;
  - wherein the aperture or scored region is positioned opposite the open end, and the aperture, when present, has a smaller diameter than the open end.

9. The apparatus of claim 8, wherein the scored region describes a cross.

10. The apparatus of claim 8, wherein the aperture or the scored region, when opened, is sized to accommodate a straw while placing a compressive force on the straw.

11. The apparatus of claim 8, wherein the apparatus comprises a rubber.

12. The apparatus of claim 8, wherein the apparatus comprises a non-Hevea latex rubber.

13. The apparatus of claim 8, further comprising a tab that extends from the rim.

14. The apparatus of claim 8, further comprising a flap projecting outward from an entirety of the rim.

15. The apparatus of claim 8, wherein the drinking container is a can.

* * * * *